United States Patent [19]

Schertz et al.

[11] 4,202,246

[45] May 13, 1980

[54] MULTIPLE CO-AXIAL OPTICAL SIGHT AND CLOSED LOOP GUN CONTROL SYSTEM

[75] Inventors: Charles W. Schertz; Edward H. Ritter, both of Claremont, Calif.

[73] Assignee: General Dynamics Pomona Division, Pomona, Calif.

[21] Appl. No.: 591,381

[22] Filed: Jun. 23, 1975

Related U.S. Application Data

[60] Continuation-in-part of Ser. No. 469,280, May 13, 1974, abandoned, which is a division of Ser. No. 404,077, Oct. 5, 1973, Pat. No. 4,040,744.

[51] Int. Cl.[2] ..... F41G 3/22

[52] U.S. Cl. ..... 89/41 EA; 89/41 L

[58] Field of Search ..... 89/41 E, 41 EA, 41 AA, 89/41 L, 41 TV, 41 SW; 102/60, 87; 250/330, 332, 339, 342; 343/7 G, 12 MD

[56] References Cited

U.S. PATENT DOCUMENTS

| | | | |
|---|---|---|---|
| 2,115,047 | 4/1938 | Stevenson | 102/87 |
| 2,458,448 | 1/1949 | Tuttle | 89/41 AA |
| 2,557,949 | 6/1951 | Deloraine | 343/7 G |
| 3,013,495 | 12/1961 | Stevenson et al. | 102/87 |
| 3,239,672 | 3/1966 | Gabloffsky | 250/342 |
| 3,696,248 | 10/1972 | Cunningham et al. | 356/152 |
| 3,812,357 | 5/1974 | Flogaus et al. | 250/330 |
| 3,848,509 | 11/1974 | Corn | 89/41 AA |

*Primary Examiner*—Stephen C. Bentley

*Attorney, Agent, or Firm*—Neil F. Martin; Edward B. Johnson

[57] ABSTRACT

A sight system for providing closed-loop differential tracking control over gun aiming, utilizing visual and non-visual optical radiation to assist the gunner in acquiring and destroying targets as well as providing information to the gun control computer for automatic acquisition and firing. The sight is used in conjunction with a cooperative ammunition round which emits pulsed flashes at a timed interval after firing and upon impact. Portions of these signals are in the non-visible spectrum, and an invisible-to-visible converter is utilized to signal the relative location of the flashes to the gunner. A similar conversion is utilized to provide information on laser designator illumination and other non-visible radiation emanating from the target.

14 Claims, 12 Drawing Figures

MULTIPLE CO-AXIAL OPTICAL SIGHT AND CLOSED LOOP GUN CONTROL SYSTEM

CROSS REFERENCE TO RELATED APPLICATION

This application is a continuation-in-part of U.S. Patent Application Ser. No. 469,280 filed May 13, 1974, now abandoned, which was a divisional application of U.S. Patent Application Ser. No. 404,077 filed Oct. 5, 1973, now U.S. Pat. No. 4,040,744, and assigned to the same assignee.

BACKGROUND OF THE INVENTION

Conventional gun systems, and particularly such gun systems as are utilized in helicopters, other aircraft and air defense gun systems, where the operator is "in the loop" for at least a portion of the functioning modes of the system, have conventionally not provided for closed-loop aim error correction. In some instances, the operator may be provided with a visual indication of the projected line of flight for the projectile, in a "heads-up display", to enable more accurate manual aiming. However, to date, such aiming systems have not been capable of achieving aim accuracies much less than ten milliradians.

The search for more accurate gun aiming systems has led to the proposal or development of various closed-loop error correction systems for use in anti-aircraft and other gun systems. Such closed-loop systems have usually been based on the use of radar to track the target and to measure the angle between target centroid and bullet path centroid at the target's range. However, radar closed-loop gun control systems are relatively complex and high in cost, and further, may impose an excessive weight penalty in certain applications. Additionally, radar closed-loop systems cannot be easily adapted to include gunner observations in the fire control sequence. Finally, such systems are particularly deficient when severe ground clutter environments are encountered.

Thus, it is desirable to have a closed-loop gun control system that is relatively light in weight and low in cost. Such a closed-loop system is particularly desirable when it provides an accuracy improvement over the ten milliradian accuracy available with conventional aiming techniques and which is passive so as not to provide signals that may be utilized by opposing forces to neutralize the gun system.

SUMMARY OF THE INVENTION

An exemplary embodiment of the invention incorporates an optical sight with provision for converting invisible optical radiation to visible signals, observable by the gunner and generating control signals utilizable by the gun control system in applying closed loop differential tracking aim correction. In the exemplary embodiment, a helmet-mounted sight incorporating the principles of the invention is utilized in a system including provision for translating helmet movements into signal corresponding to the visual line of sight. However, it is to be understood that the system is equally applicable to fixed and other mobile gun systems, with or without independent gunner targeting. Further, it is to be understood that the detectors described in connection with the gunner's sights may be duplicated on a sight system located on, or in connection with, the gun mount so that the system may alternatively be commanded by the gunner-provided signals, or be directed by the signals from the gun-mounted sight.

The sight system includes a plurality of optical energy detectors. Choice of the optical filtering and detector type for use in the system make the system responsive to several different optical energy wave lengths simultaneously. The detectors are multi-element and are divided into sectors so that the activation of the element in a particular sector on the detector matrix indicates that there exists a pre-determined angular difference between the energy from a selected source and the bore-sight axis of the sight. The bore-sight axis in the gunner-controlled sight corresponds to the visual line of sight. The gunner's field of view includes a pipper display for aiming. The display is focused at infinity. The sight also displays, at infinity, a slight signal in a sector of the gunner's sight scene, corresponding to the sector of the detector that sensed invisible radiation.

At least one of the detected bands is sensitive to the spectrum in which muzzle flash and hot body radiation predominates. Other detection bands are responsive to the radiation peaks of the timed and impact flashes of the gun projectile. In addition to wave length discrimination, the signals are processed to discriminate by pulse width. For example, the pulse width of a laser designator is utilized in distinguising it from the impact flash. Non-pulsating sources such as continuous hot-body radiation as might emanate from an aircraft or land vehicle is passed through a chopper to tranduce the continuous radiation into pulses.

The cooperative ammunition round utilized with the invention includes a timed pyrotechnic flash at a predetermined interval after firing. The timed flash is useful where there is not impact flash as may be the case in airborne targets or where the impact flash is not observable due to terrain.

The impact flash included in the cooperative round is distinguishable from the timed flash by the radiation wave length selected for the two pyrotechnic flashes.

In a typical engagement, the operator acquires the target visually and centers the bore-sight pipper on the target. A typical open-loop gun pointing solution is accomplished and the operator fires the gun. The path of flight of initial rounds is detected from the timed or impact flash. A signal corresponding to the angular error of the impact flash sensor is delivered to the gun fire control computer. The fire control computer commands a corrected aim to compensate for the detected error. The correction reduces the angular error after the initial detected round, for all subsequent rounds, to within two milliradians or less for systems with low dead zone and accurate gun pointing. Where the impact flash is not observable, the timed flash is utilized to indicate an angular deviation for the flight path of the round from the visual line of sight to the target. The gun aim is corrected on the basis of this angular error until impact flashes are observed, or the target is destroyed.

Targets may also be acquired by the cooperative radiation emissions emanating from them. For example, the muzzle flash of a firing target may be utilized to locate the target position. The muzzle flash is observable to the gunner through conversion of the radiation which is predominately in the infrared spectrum, to visible radiation form one of the light emitting sources in the invisible-to-visible converter. The observed angular relationship may be utilized by the gunner to center the bore-sight pipper on the location of the target emissions and thereby either visually acquire the target or commence firing at the assumed target location. A similar sequence is utilized in the case of a laser illuminated target. The gun sight system detects the radiation from a target illuminated by friendly forces. The gunner may turn the helmet sight to the indicated location for the laser illuminated target and proceed as described above in the muzzle flash example, or may select the automatic mode whereby the gun mount is automatically turned to eliminate the angular error between the bore-sight and the indicated direction for laser illumination. Reactive gun fire may then proceed until the target is destroyed.

BRIEF DESCRIPTION OF THE DRAWINGS

FIG. 6*a* is a longitudinal cross-sectional view, partially in perspective, of one exemplary embodiment of a small caliber ammunition round.

FIG. 6*b* is an enlarged view of the tracer assembly in FIGS. 6*a* and 6*c*.

FIG. 6*c* is a longitudinal cross-sectional view of an exemplary embodiment of a large caliber projectile.

DESCRIPTION OF THE PREFERRED EMBODIMENT

Figure 1:
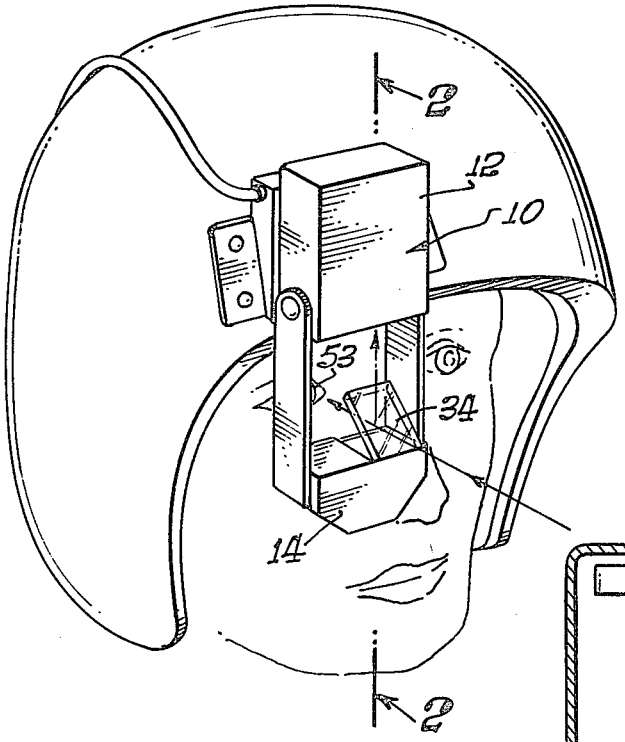
FIG. 1 is a perspective view of the helmet mounted sight.
Figure 2A:
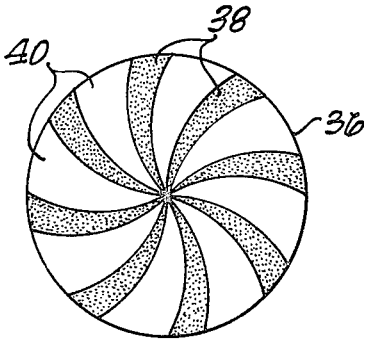
FIG. 2*a* is a face view of a chopper disc used in FIG. 2.
Figure 2:
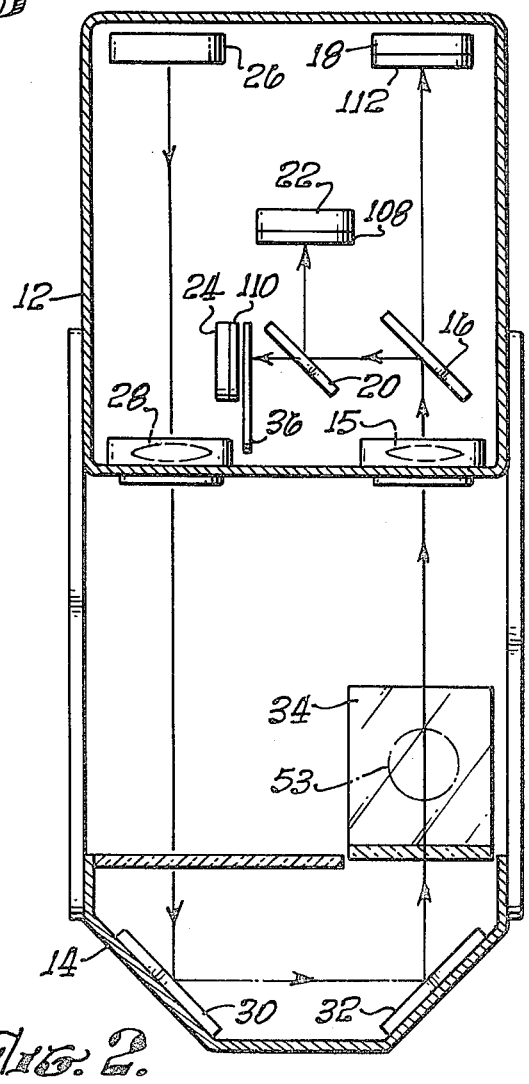
FIG. 2 is an enlarged sectional view taken on line 2—2 of FIG. 1.

Referring now to FIGS. 1 and 2 of the drawings, there is illustrated a helmet mounted sight 10 including an upper body portion 12 and lower body portion 14. The upper body portion 12 houses and mounts the detectors 18, 22 and 24. Radiant optical energy is focused on these detectors by a lens 15, for example. Lens 15 receives light from the dichroic mirror 34, which diverts a portion of the sight scene to lens 15. A first portion of the energy is reflected by dichroic mirror 16 and dichroic mirror 20 into the impact flash and laser detector 22. The energy passes through bandpass filter 108 to exclude energy in other than the bandwidth of interest, as will be described more fully hereinafter. A secondary portion of the energy passes through dichroic mirror 20 and bandpass filter 110 to the muzzle flash and hot body radiation detector 24. A light chopper 36 is positioned to intercept the energy impinging on detector 24 and is utilized to pulse continuous hot body radiation in a manner to be described more fully hereinafter. A portion of the energy incident on dichroic mirror 16 passes through and is focused upon the timed flash detector 18 through bandpass filter 112. Energy from the invisible-to-visible converter (light display) and pipper 26 is focused at infinity to the observer 53 by lens 28, and reflected on mirrors 30 and 32 and the rear face of mirror 34.

Figure 3:
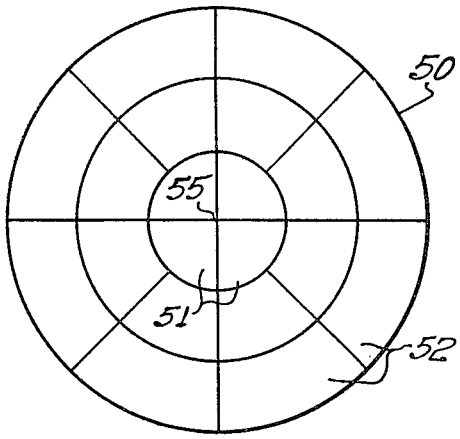
FIG. 3 is a face view of a multiple element laser/impact flash detector and similar infrared detector.

Referring now to FIG. 3, the configuration for the multiple element detectors 22 and 24 is illustrated. The detector configuration 50 is illustrated as being made up of a plurality of quadrants, as exemplified by quadrant 52, around a central quadrature of elements typified by element 51. The four center detectors are quadrature detectors for providing precision tracking. The detectors are multi-element for the purpose of converting the information handled by these detectors into visible information via the invisible-to-visible converter 26. The total detection field of view is divided into sectors. The sector upon which the applicable energy is impinged will signal the invisible-to-visible converter to display a signal to the gunner in that corresponding sector. The central portion of the detector 50 includes processed segments 51 which produce an output signal that varies in intensity in proportion to the displacement from the common center 55. By combining the signals in an amplitude monopulse fashion from the four sectors and normalizing the output to eliminate amplitude variations, a signal which is representative of the angular variation and displacement from the optical center axis is produced for any signal impinging on these sectors 51. This feature is important in providing accurate guidance to the gun aiming system.

Figure 4:
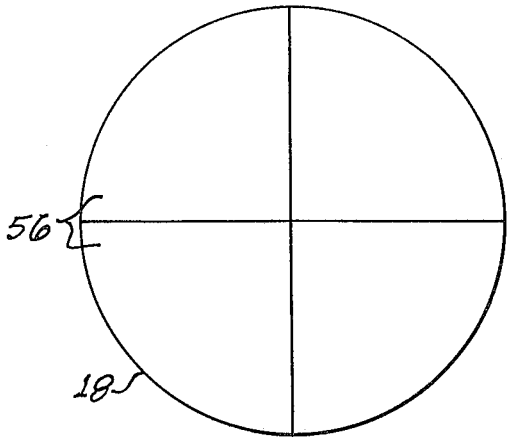
FIG. 4 is a face view of a timed flash quadrature detector.

Referring now to FIG. 4, the detector 18 is illustrated. Detector 18 is intended to produce a signal in response to the timed flash. Detector 18 is divided into four quadrants 56 processed in the manner previously described for the elements 51 in detector 50. Therefore, detector 18 is capable of providing signals to the gun fire control system which corresponds to the angular error between the line of sight and the location of the projectile at the instant of the timed flash.

Figure 5:
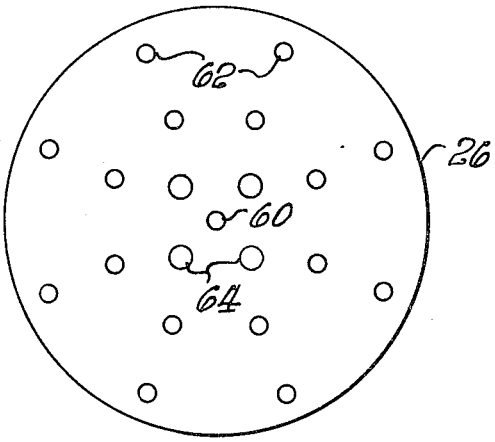
FIG. 5 is a face view of the invisible-to-visible converter.

Referring now to FIG. 5, the configuration for the invisible-to-visible converter display 26 is illustrated. The display 26 includes a plurality of light emitting diodes (LED) 62 which are spaced at the centroide of the quadrants of corresponding detectors 24 and 22. The central quadrant 64 corresponds to the four inner quadrants 51 in FIG. 3. A bore-sight pipper or aim point is provided by the central LED 60.

Figure 6:
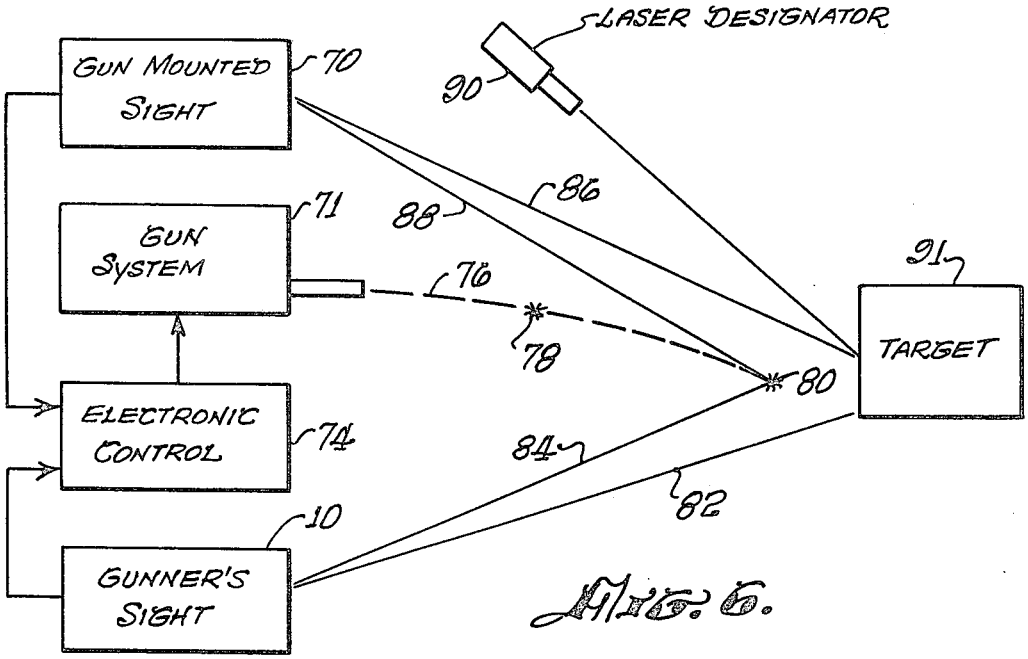
FIG. 6 is a block diagram of a typical system utilizing the sight.

Referring now to FIG. 6, the system block diagram for an embodiment of the invention is illustrated. The system incorporates a gunner's sight 10 and a gun-mounted sight 70. These sights are similar excepting that the gun-mounted sight does not include provision for visual display of information. Either sight may provide information to the electronic gun control 74 which commands aim changes to gun system 71. The gunner's sight is illustrated as being directed along a visual line of sight 82 to visually acquired target 91. An exemplary first round is illustrated as passing along trajectory 76 and emitting timed flash 78 and impact flash 80. Impact flash 80 is illustrated as being short of the target. Thus the gunner's sight would sense the impact flash 80 along sight line 84.

The use of the gun mounted sight is illustrated in conjunction with a laser designator 90 which is illuminating target 91. The reflected laser illumination is detected by the gun mounted sight along aim line of sight 86. The first round is detected via the impact flash 80 along flash line of sight 88.

The angular error for either system of aim is converted by the electronic control 74 into aim change commands to produce a subsequent round which is correctly aimed within two milliradians, for example.

In FIG. 6*a*, an exemplary round of ammunition 92 is shown as having a propellant-filled cartridge case 93 rigidly crimped to the base portion of a projectile or bullet 94. The bullet 94 includes a frangible, hollow windscreeen 95 containing an appropriate incendiary composition or impact flash material 96 which emits the impact flash 80. The impact flash material 96 is selected to provide the desired spectral output. An impact fuze (not shown) operably disposed within the windscreen may be desirable. A slug or penetrator 97 is disposed within the body of the bullet 94. An optional rotating band 98 is provided on the bullet 94 for use, for example, with 30-mm ammunition rounds, if desired. Substantially centrally disposed in the aft end of the bullet 94 is a cavity 98 of appropriate size to receive a flammable tracer or timed flash assembly 99 which emits the timed flash 78. Referring now to FIG. 6*b*, an enlarged view of the tracer assembly 99 is illustrated and includes a container 100 holding an igniter 101 juxtaposed at its outer portion with a timed delay train 102, and a flammable tracer composition or timed flash material 103 having a spectral output different from that of the impact flash material 96 contained inside an open-ended liner 104. The timed flash material 103 is juxtaposed with the delay train 102 at the open end of the liner 104. FIG. 6*c* shows a larger projectile 105 of the 105-mm howitzer type, for example, designed for use with a sabot (not shown). The projectile 105 includes a frangible, hollow windscreen 95' filled with an incendiary composition or impact flash material 96'. A slug or penetrator 97' is disposed within the projectile 105. As in the case of the bullet 94, the flammable tracer or timed flash assembly 99 is substantially centrally disposed in the aft end of the projectile 105 inside an appropriate cavity 106. As is apparent to those skilled in the art, the ammunition round 92, the projectile 105 and the tracer or timed flash assembly 99 can be constructed in different ways using various materials, propellants, igniters, explosives, charges, pyrotechnic compositions, fuzes, and so forth, as set forth, for example, in Department of the Army Technical Manual No. TM 9-1900 published jointly by the Departments of the Army and the Air Force in June 1956. In operation, the igniter 101 of the tracer or timed flash assembly 99 is ignited by the propellant when the ammunition round 92 or the projectile 105 are fired. The igniter 101 ignites the delay train 102 which burns at the desired rate until the delayed burning portion contacts the flammable tracer composition or timed flash material 103 at which time the timed flash 78 is emitted. When either the bullet 94 or the projectile 105 impacts, the contact and centrifugal forces cause the frangible windscreens 95 or 95' to be broken open and the impact flash material 96 or 96' to be ignited and to be spewed substantially in a circle to produce the impact flash 80.

Figure 7:
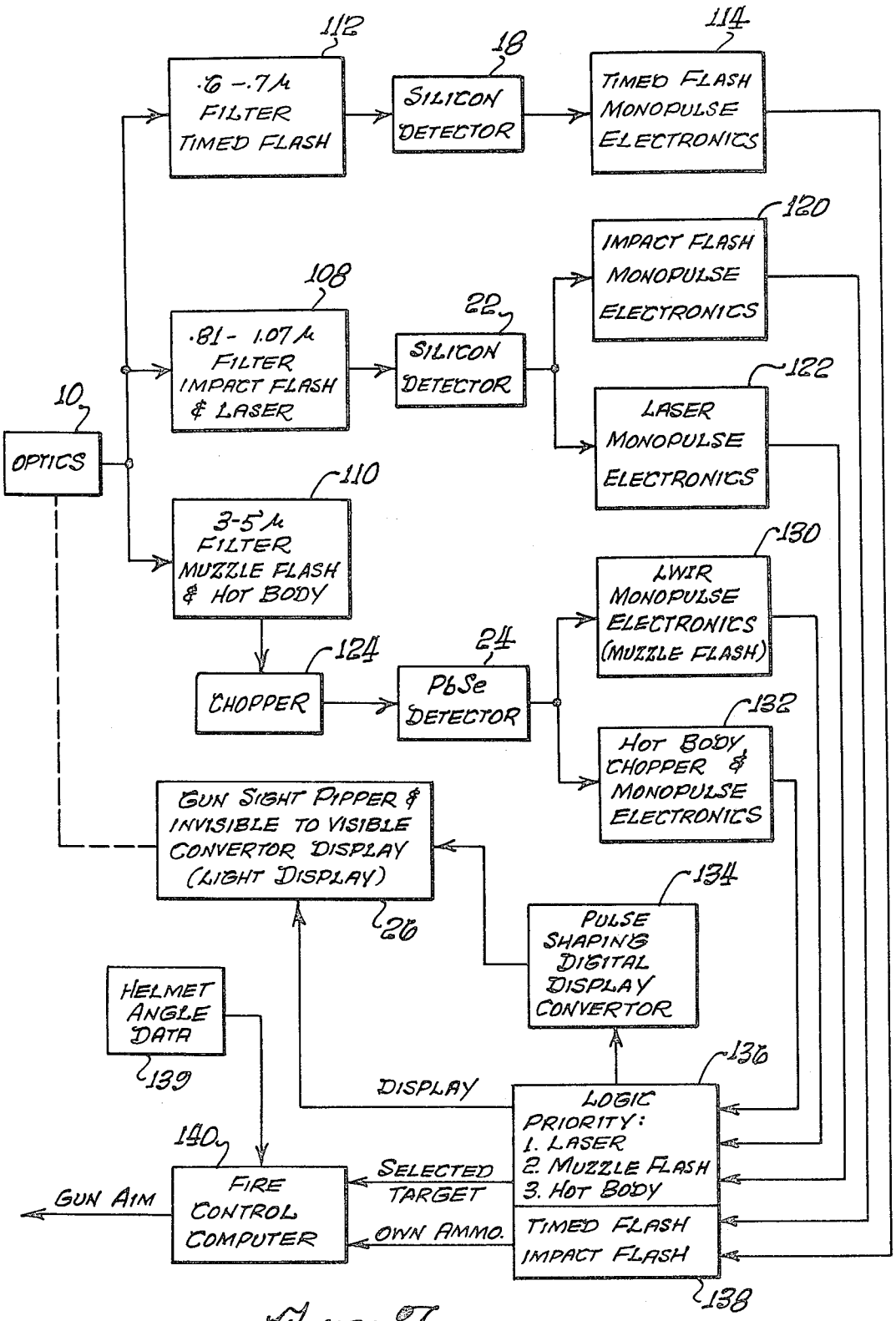
FIG. 7 is a block diagram of the gun sight system.

Referring to FIG. 7, the system block diagram for the entire gun control system is illustrated. The optics 10 provide focused radiation which passes through bandpass filters 112, 108 and 110 to illuminate the detectors 18, 22, and 24, respectively. Filter 112 eliminates wave lengths not in the bandpass between 0.6 and 0.7 microns. This bandpass includes the maximum intensity portion of the radiation in the timed flash. A silicon multi-element detector is utilized for the detector 18, for example, and the monopulse output of the detector, from the four center sectors 51 of the multiple element detector 50 in FIG. 3, is delivered to the timed flash monopulse electronics network 114. Timed flash monopulse electronics network 114 converts the signal into a signal representative of the angular magnitude and orientation for the error.

The light energy incident on filter 108 is limited to the bandpass of approximately 0.81 to 1.07 microns. This bandpass includes the peak strength wave lengths in the impact flash and is also inclusive of the laser radiation wave lengths. Thus, the signal from the silicon (for example) detector 22 may be from either an impact flash or laser. This ambiguity is resolved by virtue of the different pulse length for these two sources of radiation in the impact flash and laser monopulse electronics networks 120 and 122. Since the laser does not include any radiation in the visible wave length, it is delivered to the pulse shaping digital display converter 134 and the signal is regularized and amplified so that it may be delivered to the invisible-to-visible converter display (light display) 26 to illuminate the appropriate LED. Radiation in the three to five micron wave length range is passed by bandpass filter 110 to detector 24 which may be a lead selenide detector, for example. This bandpass includes muzzle flash and hot body radiation. A chopper 124 is utilized to reduce the continuous hot body radiation to pulsed form. Thus the output of detector 24 is a pulsed signal. The pulse width determines whether the information will be processed by electronics network 130 or by network 132. In the case of muzzle flash pulse width, the information is processed and delivered to the logic network 136 by the long wavelength IR monopulse electronics network 130 for eventual display through the invisible-to-visible converter 26. Hot body and monopulse electronics network 132 detects the precise pulse width to determine the angular displacement from center of the hot body radiation. The pulse width varies with the displacement from center, in accordance with the transparent portions 40 of chopper 36 illustrated in FIG. 2*a*. It is also possible to use the phase relationship between the rotational frequency of the chopper and the phase of the pulsed hot body radiation signal from the detector 24 to resolve the angular orientation of the radiation. Since the primary strength of the radiation may be in the invisible range, this information is also delivered to the pulse shaping digital display converter 134 via the logic network 136 for eventual display on the invisible-to-visible converter 26. Logic network 136 establishes a target signature priority of display and input to the fire control computer 140 so that only the most pertinent information is displayed as an illuminated LED in display 26. The logic network 138 sends the impact flash angle data to the fire control computer 140 when that is available, and utilizes the timed flash only when the impact flash is not detected by the detector 22. The output of the logic network 136 is used in conjunction with the output of the timed flash/impact flash network 138 to generate in the fire control computer 140 a differential error signal between the centroid of the target and the centroid of the bullet pattern. In addition, helmet angle data, shown as block 139 in FIG. 7, is fed into the fire control computer 140. Such angle data could be obtained from a pantagraph or servoed gimbal devices in other systems, for example. The result of the foregoing is a closed-loop solution that is not affected by small imperfections in the target tracking. Thus the fire control computer 140 receives information on the relative orientation between the target location and the line of flight of the projectile. This differential angular error between these two positions results in closed-loop gun aim orders to reduce the error for subsequent rounds. Closed-loop corrections are in addition to a standard director fire control system.

The amplitude monopulse electronics networks 114, 120, 122, 130 and 132 are of the type used in radar systems which derive angle-error information on the basis of a single pulse. This radar tracking technique is also called "simultaneous lobing" by those skilled in the art. Conventional digital techniques are used in the logic networks 136 and 138 with such circuits as a read-only memory, NAND gates, etc., which, in effect, form a truth table. As is known, a truth table is a table that describes a logic function by listing all possible combinations of input values and indicating for each such combination the true output values. The fire control computer 140 is a general purpose digital computer which uses the outputs of the logic networks 136 and 138 for the solution of the fire control equation.

OPERATION

Figure 8:
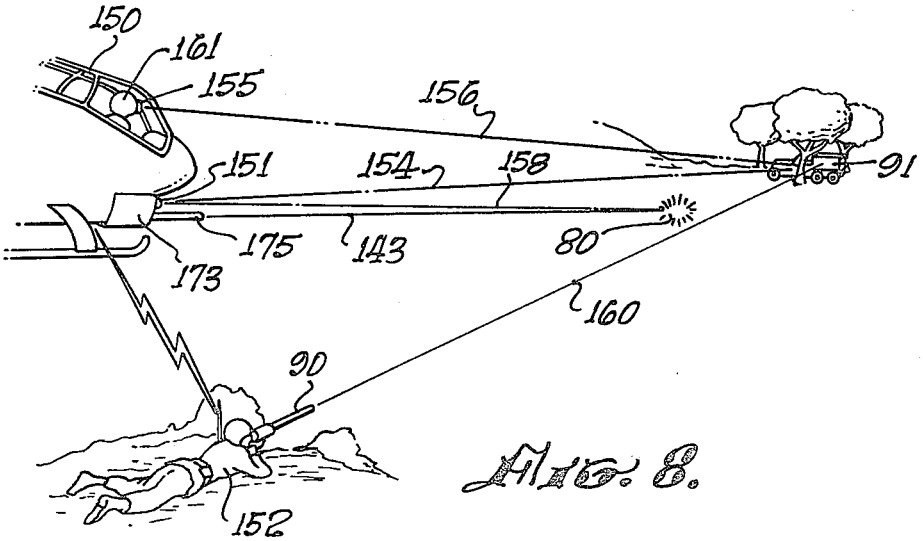
FIG. 8 is a diagram of a typical use of the sight.
Figure 9:
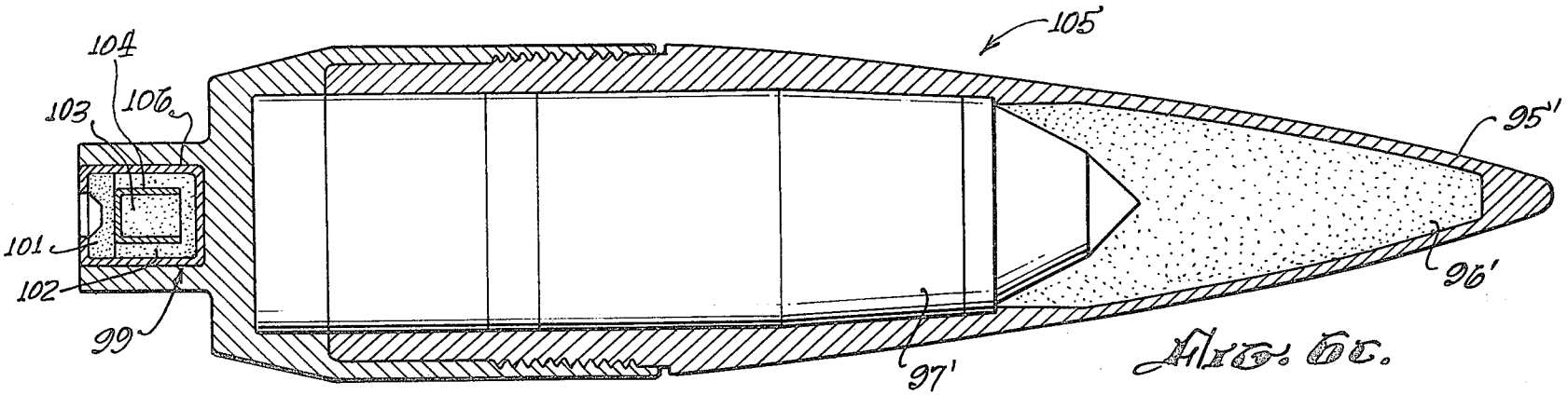
Figure 8:
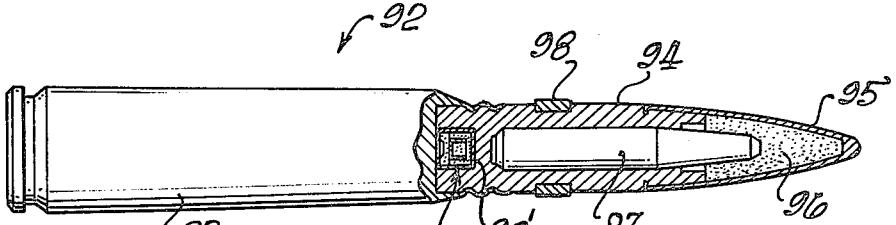
Figure 9A:
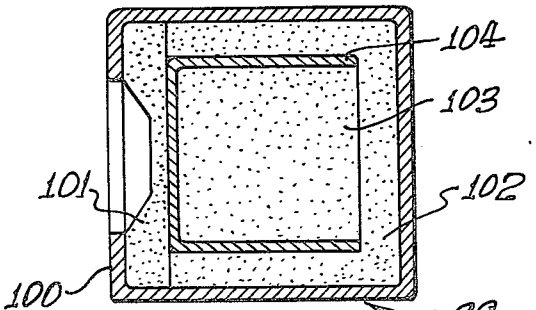

The use of the system of the invention in a typical operational environment is illustrated in FIG. 8. A helicopter gun ship 150 is provided with a gun mounted sight 151 and helmet mounted sight 155. Target 91 is illustrated as being illuminated by a laser designator 90 along illumination path 160. The laser designator is visually aimed by an observer 152 who has visually acquired the target. Communications between the observer and the helicopter gun ship indicate the general vicinity of the target so that the vehicle is turned to bring the target within the optical field of view of this sight. As soon as the laser return along light paths 154 or 156 is detected, the gunner 161 in the helicopter gun ship 150 will be provided with a signal corresponding to the angular error between the line of sight and the target location. The gunner turns his head and/or the turret 173 gimbals to align the optical line of sight with the target location. The gun 175 is then fired resulting in a projectile path 143 and an impact designated by impact flash 80. The impact flash return along line 158 is detected by the gun sight optics 151, and the angular error between the laser return indicating the target location on line 154, and the impact flash return on line 158 is sensed. The angular deviation and orientation of the sensed error results in commands to gun 175 to a new aim orientation. Subsequent rounds are fired and detected until the target is destroyed.

In the exemplary application of a helicopter gun ship, the system of the invention may be employed against enemy gun fire. The invention can be used in conjunction with a prime threat detector or without. A prime threat detector determines the general location of the gun that is firing the bullets coming closest to the aircraft at a particular instant. This information is used by the gunner with his helmet mounted sight, via head movements, to include the opposing fire location within the field of view of the system. The muzzle flashes from the firing gun will be detected at detector 24 and decoded as muzzle flashes by the monopulse muzzle flash electronics network 130. The muzzle flash signal from the network 130, if the muzzle flash is the highest priority target detected, will be coded with a distinguishing repetitive rate and pulse length by the pulse shaping digital display converter 134. From the converter 134 the coded pulses are fed to the invisible-to-visible converter 26, causing the light emitting diode in the corresponding sector of the light display to be illuminated. For example, LED 62 would be illuminated to indicate a muzzle flash in that direction and distance. The light from LED 62 is superimposed on the gunner's sight scene and appears at infinity by the effect of lens 28. Thus the operator is capable of turning the sight to center the pipper 60 on the location of the muzzle flashes. When the muzzle flashes are bore-sighted, an indication will be provided on all four lights 64. The central portions of the detector 51 are providing a proportional signal throughout the aiming process indicating the angular error and orientation for use in the gun control computer and gun aiming system. At this stage, the gunner may elect to commence firing based on the visual line-of-sight, or can turn the system over to the gun-mounted sight, allowing the system to automatically update the aim based on continuing muzzle flashes and upon the angular error as evidenced by impact flashes.

In the case of a cooperative target, that is a target which is either illuminated by a laser designator or a target emitting hot body or muzzle flash radiation, it is not necessary to visually track the target. The aim information is provided by the cooperative radiation, and the aim is updated by commands from the gun fire control computer 140 in response to the angular error. The angular error may be derived from the impact flash, as in air-to-ground engagements, where the location of the impact flash is visible from the aircraft. However, where the impact flash is not visible, due to impact beyond the line of sight, or as in air-to-air engagements, the system logic commands corrective response to the timed flash. The timed flash is set to radiate a one millisecond pulse, for example, at a predetermined timed interval from firing such as one half second. The interval is selected to be equivalent to a nominal range or, for example, one half of the effective range of the system. In this manner, it is possible to obtain a rough approximation of range by determining whether or not the timed flash has radiated prior to impact when used against ground targets. Whereas the timed flash is not a precise measurement of angular error at the target distance, due to the trajectory of the projectile, it is a sufficient approximation to close the aim error and eventually result in an impact flash due to target hits or hits in the immediate vicinity of a ground target.

Having described my invention, I now claim:

1. In a closed-loop gun control system, that improvement comprising:

an ammunition round having a delayed timed flash and an impact flash, said timed flash having an optical energy output that is invisible and different from said impact flash.

an optical energy detection system for detecting energy generated by the timed flash and the impact flash of said ammunition round, including, optical sight means operably associated with said ammunition round for establishing a desired line of fire, said optical sight means including optical energy detector means for determining the angular displacement and orientation of said timed flash and said impact flash from the desired line of fire.

2. The improved closed-loop gun control system of claim 1, wherein said line of fire is established by sensed radiation.

3. The improved closed-loop gun control system according to claim 1, wherein said detector means includes a central portion thereof that produces a signal having an intensity that is proportional to the displacement from the common center for providing precision tracking.

4. The improved closed-loop gun control system according to claim 1, wherein said ammunition round includes a tracer assembly having a time delay train operably disposed therewith to provide said timed flash.

5. The improved closed-loop gun control system according according to claim 1, wherein said ammunition round additionally includes an impact flash material operably disposed within said round to provide said impact flash.

6. In a closed-loop gun control system, that improvement comprising:

an ammunition round having a delayed timed flash and an impact flash, said timed flash having an optical energy output that is invisible and different from said impact flash, optical sight means operably associated with said ammunition round for establishing a desired line of fire, said optical sight means including optical energy detector means for determining the angular displacement and orientation of said timed flash and said impact flash from the desired line of fire, and further including associated laser means for providing laser illumination for reflection to said optical energy detector means.

7. In closed-loop gun control system, that improvement comprising:

an ammunition round having a delayed timed flash and an impact flash, said timed flash having an optical energy output that is invisible and different from said impact flash, optical sight means operably associated with said ammunition round for establishing a desired line of fire, said optical sight means including optical energy detector means for determining the angular displacement and orientation of said timed flash and said impact flash from the desired line of fire, said optical energy detector means including an impact flash and laser detector.

8. In a closed-loop gun control system, that improvement comprising:

an ammunition round having a delayed timed flash and an impact flash, said timed flash having an optical energy output that is invisible and different from said impact flash, optical sight means operably associated with said ammunition round for establishing a desired line of fire, said optical sight means including optical energy detector means for determining the angular displacement and orientation of said timed flash and said impact flash from the desired line of fire, said optical energy detector means including a timed flash detector.

9. In a closed-loop gun control system, that improvement comprising:

an ammunition round having a delayed timed flash and an impact flash, said timed flash having an optical energy output that is invisible and different from said impact flash, optical sight means operably associated with said ammunition round for establishing a desired line of fire, said optical sight means including optical energy detector means for determining the angular displacement and orientation of said timed flash and said impact flash from the desired line of fire, said optical energy detector means includes a central portion thereof that produces a signal proportional to the displacement from the common center for providing precision tracking, said optical energy detector means including an impact flash and laser detector.

10. The improved closed-loop gun control system according to claim 9, wherein said optical energy detector means includes a timed flash detector.

11. The improved closed-loop gun control system according to claim 10, wherein said optical energy detector means includes a muzzle flash and hot body radiation detector.

12. The improved closed-loop gun control system according to claim 11, wherein said optical energy detector means includes a plurality of quadrants.

13. The improved closed-loop gun control system according to claim 12, wherein at least one of said optical energy detector means includes a light chopper with alternating light transmitting and light blocking radial segments.

14. The improved closed-loop gun control system according to claim 12, and further including associated laser means for providing laser illumination for reflection to said optical energy detector means.

* * * * *